US012577840B2

(12) United States Patent
Blott et al.

(10) Patent No.: US 12,577,840 B2
(45) Date of Patent: Mar. 17, 2026

(54) ISOLATION PLUGS, RATCHET SYSTEMS, AND METHODS TO SET A PACKING ELEMENT

(71) Applicant: Halliburton Energy Services, Inc., Houston, TX (US)

(72) Inventors: Evan Blott, Carrollton, TX (US); Donald Ray Smith, Duncan, OK (US); Matthew Dexter, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/931,935

(22) Filed: Oct. 30, 2024

(65) Prior Publication Data

US 2025/0059842 A1 Feb. 20, 2025

Related U.S. Application Data

(63) Continuation of application No. 18/234,363, filed on Aug. 15, 2023, now Pat. No. 12,188,314.

(51) Int. Cl.
*E21B 23/06* (2006.01)
*E21B 33/124* (2006.01)

(52) U.S. Cl.
CPC ..... *E21B 23/06* (2013.01); *E21B 33/124* (2013.01)

(58) Field of Classification Search
CPC ..... E21B 23/06; E21B 33/12
See application file for complete search history.

(56) References Cited

U.S. PATENT DOCUMENTS

| | | | |
|---|---|---|---|
| 10,385,651 B2 | 8/2019 | Smith et al. | |
| 2017/0268310 A1 | 9/2017 | Shkurti et al. | |
| 2018/0023359 A1 | 1/2018 | Xu | |
| 2018/0171744 A1 | 6/2018 | Markel et al. | |
| 2020/0240233 A1* | 7/2020 | Chenault | E21B 23/06 |

FOREIGN PATENT DOCUMENTS

| | | |
|---|---|---|
| CN | 216811639 U | 6/2022 |
| WO | 2015077722 A1 | 5/2015 |

OTHER PUBLICATIONS

International Search Report and Written Opinion for PCT/US2023/030409 mailed May 8, 2024.

* cited by examiner

*Primary Examiner* — Tara Schimpf
*Assistant Examiner* — Lamia Quaim
(74) *Attorney, Agent, or Firm* — Scott Richardson; C. Tumey Law Group PLLC

(57) ABSTRACT

An isolation plug includes a ratchet wedge having a set of threads formed along an interior surface of the ratchet wedge, where the set of threads are configured to permit movement in a first direction and restrict movement in a second direction. The isolation plug also includes a ratchet shoe configured to shift in the first direction to ratchet into the ratchet wedge to engage the ratchet wedge, where the ratchet shoe has a corresponding set of threads that are configured to engage the set of threads of the ratchet wedge to permit the ratchet shoe to shift in the first direction, and restrict movement in the second direction. The isolation plug further includes a packing element positioned in between the ratchet shoe and the ratchet wedge, the packing element configured to expand radially as the ratchet shoe is shifted in the first direction.

20 Claims, 10 Drawing Sheets

ISOLATION PLUGS, RATCHET SYSTEMS, AND METHODS TO SET A PACKING ELEMENT

BACKGROUND

The present disclosure relates generally to isolation plugs, ratchet systems, and methods to set a packing element.

Hydrocarbon wells are sometimes divided into multiple zones, and well operations are performed sequentially or concurrently at multiple zones. Packers and frac plugs are sometimes deployed at or near boundaries of each zone to fluidly isolate the respective zone from adjacent zones.

BRIEF DESCRIPTION OF THE DRAWINGS

Illustrative embodiments of the present disclosure are described in detail below with reference to the attached drawing figures, which are incorporated by reference herein, and wherein.

Figure 1:
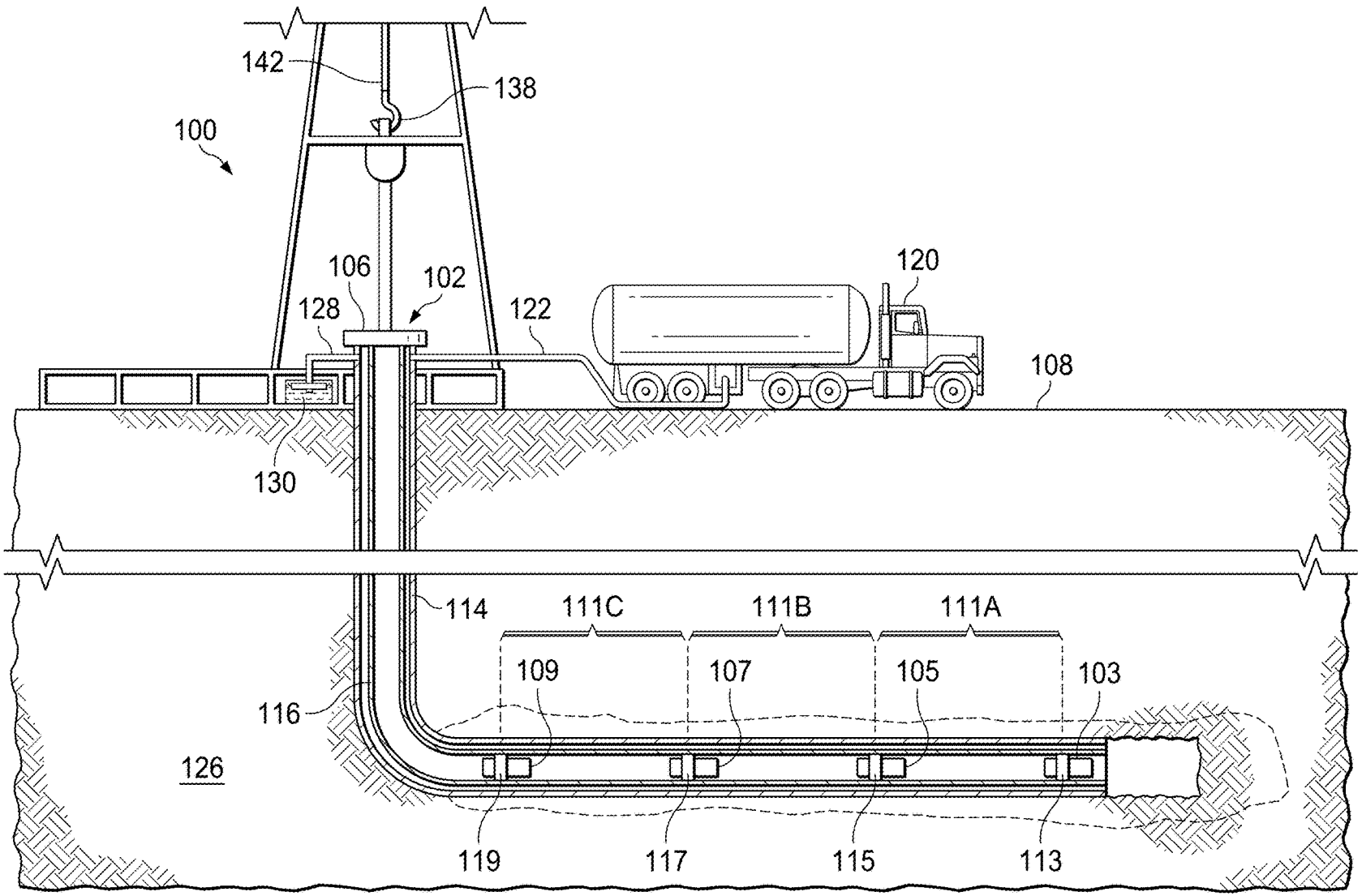
FIG. 1 is a schematic, side view of a well environment where isolation plugs each having a ratchet system are deployed.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to isolation plugs, ratchet systems, and methods to set a packing element. An isolation plug includes a ratchet wedge having a set of threads formed along an interior surface of the ratchet wedge, where the threads are configured to permit movement in a direction towards the ratchet wedge and to restrict movement in a second direction away from the ratchet wedge. As referred to herein, a ratchet wedge is any wedge or wedge-like element configured to permit movement in one direction and restrict movement in another direction. The isolation plug also includes a ratchet shoe that is configured to shift in the first direction to ratchet into the ratchet wedge to engage the ratchet wedge. More particularly, the ratchet shoe includes a mandrel (where the mandrel is a component of the ratchet shoe) or is coupled to a mandrel having a corresponding set of threads that are configured to engage the set of threads of the ratchet wedge to permit the ratchet shoe to shift in the first direction, and restrict movement in the second direction once the set of threads are engaged with the corresponding set of threads.

The isolation plug further includes a packing element that is positioned in between the ratchet shoe and the ratchet wedge, where the packing element is configured to expand radially as the ratchet shoe is shifted in the first direction. In some embodiments, the packing element is a component of a frac plug. In some embodiments, the packing element radially expands in response to force/pressure applied by the ratchet shoe and/or ratchet wedge as the ratchet shoe shifts in the first direction.

In some embodiments, the isolation plug includes a slip that is coupled to an exterior of the ratchet wedge, where the slip is configured to engage the ratchet wedge to hold the isolation plug in position. In one or more of such embodiments, the slip has a set of teeth (first set of teeth) along an interior surface of the slip, and the ratchet wedge has a corresponding set of teeth (second set of teeth) along an exterior surface that is configured to engage the first set of teeth to engage the slip to the ratchet wedge. More particularly, engagement of the first set of teeth and the second set of teeth restricts the threads of the ratchet wedge from disengaging the corresponding threads to prevent the ratchet wedge from disengaging the slip. In one or more of such embodiments, the ratchet wedge has or comes into contact with one or more collets that are configured to engage the ratchet shoe to restrict the ratchet shoe from shifting in the second direction. Further, engaging the first set of teeth and the second set of teeth applies force/pressure to the one or more collets to engage the ratchet shoe. In one or more of such embodiments, the amount of force/pressure applied to the collets increases as more and more teeth of the first and second sets of teeth are engaged with each other, thereby further securing the ratchet shoe to the ratchet wedge. In one or more of such embodiments, the ratchet wedge has or comes into contact with a lock ring that is configured to engage the ratchet shoe to restrict the ratchet shoe from shifting in the second direction. Further, engaging the first set of teeth and the second set of teeth applies force/pressure to the lock ring to engage the ratchet shoe. In one or more of such embodiments, the amount of force/pressure applied to the lock ring increases as more and more teeth of the first and second sets of teeth are engaged with each other, thereby further securing the ratchet shoe to the ratchet wedge. In one or more of such embodiments, the isolation plug also includes a mule shoe that is initially coupled to the slip and configured to guide the isolation plug to a desired location within a wellbore.

A ratchet system, similar to the isolation plugs described herein, includes a ratchet wedge having a set of threads formed along an interior surface of the ratchet wedge, where the set of threads configured to permit movement in a first direction towards the ratchet wedge and to restrict movement in a second direction away from the ratchet wedge. The ratchet system also includes a ratchet shoe that is configured to shift in the first direction to ratchet into the ratchet wedge to engage the ratchet wedge. The ratchet shoe includes and/or is coupled to a mandrel having a corresponding set of threads that are configured to engage the set of threads of the ratchet wedge to permit the ratchet shoe to shift in the first direction, and restrict movement in the second direction. Force/pressure applied by the ratchet wedge and the ratchet shoe onto a packing element that is positioned in between the ratchet shoe and the ratchet wedge expands the packing element radially to set the packing element. In some embodiments, the ratchet system includes multiple pairs of ratchet shoes and ratchet wedges that are configured to set different packing elements at different downhole locations. In one or more of such embodiments, the ratchet system is configured to sequentially engage different pairs of ratchet shoes and ratchet wedges to sequentially set different packing elements. In one or more of such embodiments, the ratchet system is configured to simultaneously or near simultaneously engage multiple pairs of ratchet shoes and ratchet wedges to simultaneously or near simultaneously set off multiple packing elements. Additional descriptions of the foregoing isolation plugs, and methods to set a packing element are described in the paragraphs below and are illustrated in FIGS. 1-6.

Turning now to the figures, FIG. 1 is a schematic, side view of a well environment 100 in which multiple isolation plugs 103, 105, 107, and 109 are deployed in a well 102. As shown in FIG. 1, a wellbore 114 of well 102 extends from surface 108 of well 102 to or through formation 126.

A hook 138, cable 142, traveling block (not shown), and hoist (not shown) are provided to lower a conveyance 116 that is coupled to four isolation plugs 103, 105, 107, and 109 down wellbore 114 of well 102 or to lift conveyance 116 up from wellbore 114 of well 102. In one or more embodiments, conveyance 116 may be a drill string, drill pipe, wireline, slickline, coiled tubing, production tubing, downhole tractor or another type of conveyance operable to be deployed in wellbore 114. At a wellhead 106, an inlet conduit 122 is coupled to a fluid source 120 to provide fluids, such as stimulation fluids, downhole. In the embodiment of FIG. 1, conveyance 116 has one or more internal cavities that provide fluid flow paths from surface 108 downhole. Conveyance 116 also has one or more return paths to permit fluids to flow uphole through a diverter or an outlet conduit 128 and into a container 130 at wellhead 106.

In the embodiment of FIG. 1, isolation plugs 103, 105, 107, and 109 are positioned along boundaries of zones 111A, 111B, and 111C, respectively. Each of first isolation plug 103, second isolation plug 105, and third isolation plug 107 has a ratchet wedge and a ratchet shoe, which are configured to engage (ratchet onto) each other to set a corresponding packing element 113, 115, 117, and 119, respectively. More particularly, each ratchet wedge has threads formed along a surface of the ratchet that are configured to engage one or more corresponding threads formed along a surface of the ratchet shoe. The engagement of the threads of the ratchet wedge to corresponding threads of the racket shoe shifts the ratchet shoe towards the ratchet wedge. Force/pressure applied to the packing element by the ratchet wedge and/or ratchet shoe sets packing element 113, 115, 117, or 119, which in the embodiment of FIG. 1 radially expands outwards to isolate zones 111A, 111B, and 111C, respectively. Further, the configurations of the threads of the ratchet shoe and the threads of the ratchet wedge prevent the ratchet shoe from shifting away from the ratchet wedge, thereby holding isolation plugs 103, 105, 107, or 109 in place. Additional components of isolation plugs similar to isolation plugs 103, 105, 107, and 109 are described herein and are illustrated in at least FIGS. 2A-5B.

Although FIG. 1 illustrates four isolation plugs 103, 105, 107, and 109 that are positioned along the boundaries of three zones 111A, 111B, and 111C, in some embodiments, a different number of isolation plugs (not shown) are disposed along the boundaries of a different number of zones (not shown). Additional descriptions of isolation plugs 103, 105, 107, and 109, and operations performed by the isolation plugs and ratchet systems are provided herein and are illustrated in at least FIGS. 2A-6.

Figure 2A:
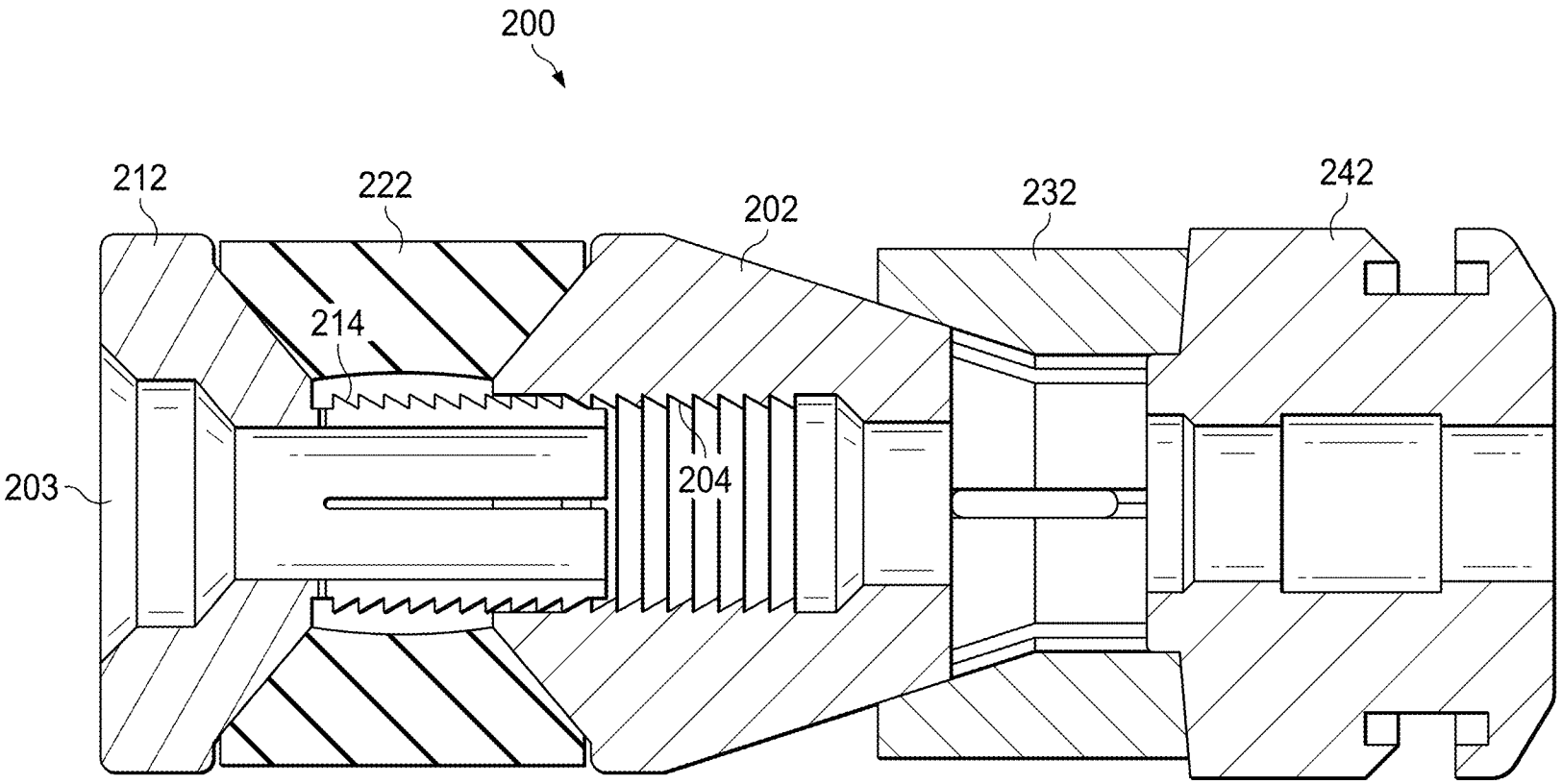
FIG. 2A is a cross-sectional view of an isolation plug deployable in the well of FIG. 1.

FIG. 2A is a cross-sectional view of an isolation plug 200 deployable in well 102 of FIG. 1. In the embodiment of FIG. 2A, isolation plug 200 includes a ratchet wedge 202 having threads (or teeth or profiles) 204 formed along an interior surface of ratchet wedge 202. Isolation plug 200 also has a ratchet shoe 212 that is coupled to or includes a mandrel 203 having corresponding threads (or teeth or profiles) 214 that are configured to engage threads 204 to permit movement of ratchet shoe 212 towards ratchet wedge 202, but prohibit ratchet shoe 212 from moving away from ratchet wedge 202. In some embodiments, the dimensions of threads 204 and 214 are shaped to permit movement of ratchet shoe 212 towards ratchet wedge 202, but prohibit ratchet shoe 212 from moving away from ratchet wedge 202. A packing element 222 is positioned in between ratchet wedge 202 and ratchet shoe 212. Isolation plug 200 also includes a slip 232 configured to hold isolation plug 200 in position, and a mule shoe 242 that is configured to guide isolation plug 200 to a desired downhole location, such as near a boundary of a zone. Pressure or force is applied to ratchet wedge 202, mandrel 203, and/or ratchet shoe 212 to shift ratchet shoe 212 towards ratchet wedge 202. The dimensions and configurations of threads 204 and 214 permit ratchet shoe 212 to shift towards ratchet wedge 202, but prevent ratchet shoe 212 from shifting away from ratchet wedge 202. As ratchet shoe 212 continues to shift towards ratchet wedge 202, force/pressure applied by ratchet wedge 202 and ratchet shoe 212 coming into contact with packing element 222 sets packing element 222. In the embodiment of FIG. 2A, force/pressure applied by ratchet wedge 202 and ratchet shoe 212 coming into contact with packing element 222 causes packing element 222 to radially expand outwards, such as towards the walls of wellbore 114 of FIG. 1.

Figure 2B:
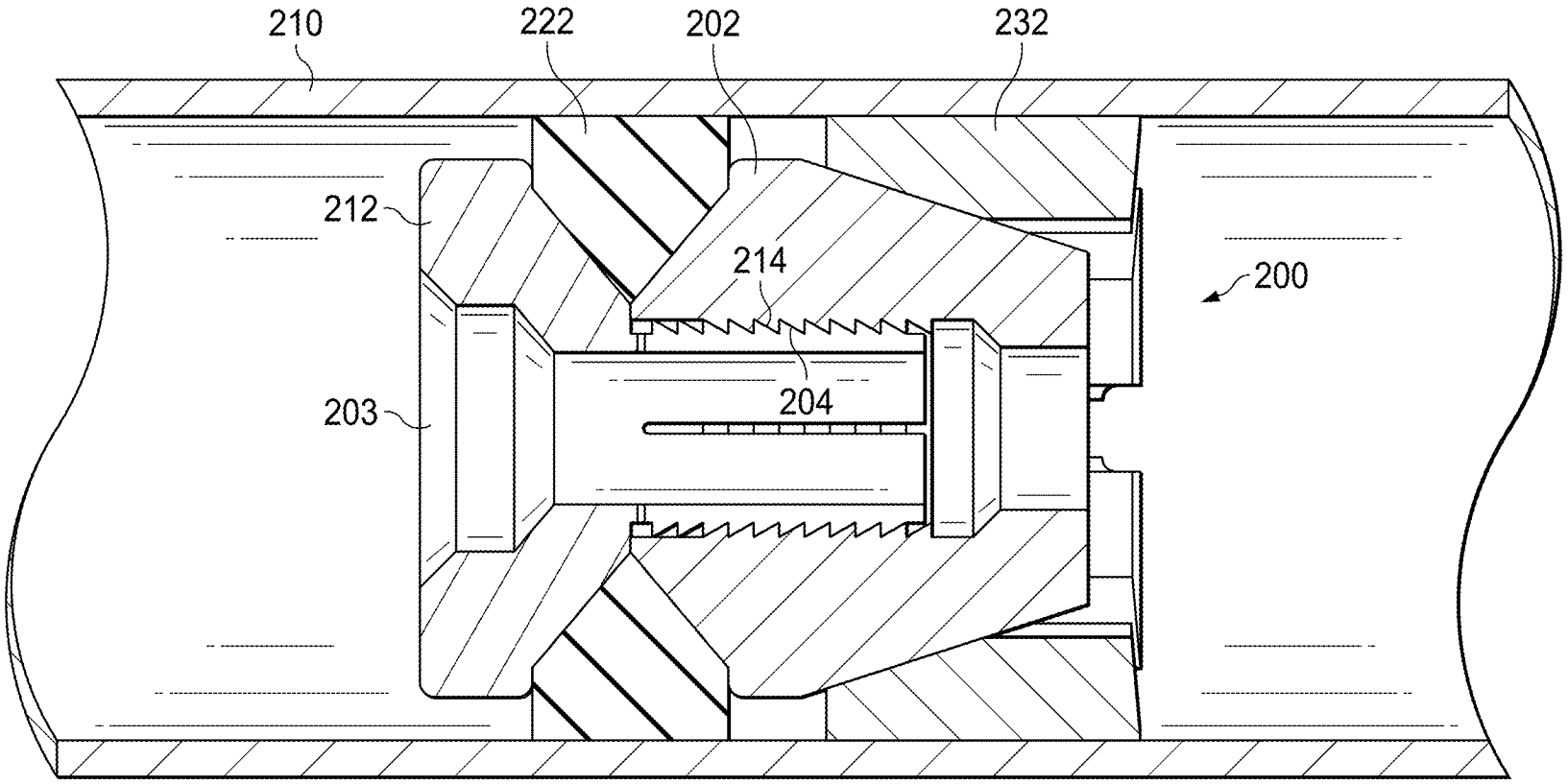
FIG. 2B is a cross-sectional view of the isolation plug of FIG. 2A after the isolation plug is set.

FIG. 2B is a cross-sectional view of isolation plug 200 of FIG. 2A after packing element 222 is set. In the embodiment of FIG. 2B, ratchet shoe 212 has ratcheted onto ratchet wedge 202. Further, force/pressure applied by ratchet wedge 202 and ratchet shoe 212 coming into contact with packing element 222 has caused packing element 222 to radially expand outwards to a wall 210. Further, the engagement of threads 204 to threads 214 prevents ratchet shoe 212 from shifting away from ratchet wedge 202, thereby maintaining the set position of packing element 222. In the embodiment of FIG. 2B, mule shoe 242 (not shown) is detached from isolation plug 200. In some embodiments, a portion of mule shoe 242 remains attached to isolation plug 200 after packing element 222 is set.

Figure 3A:
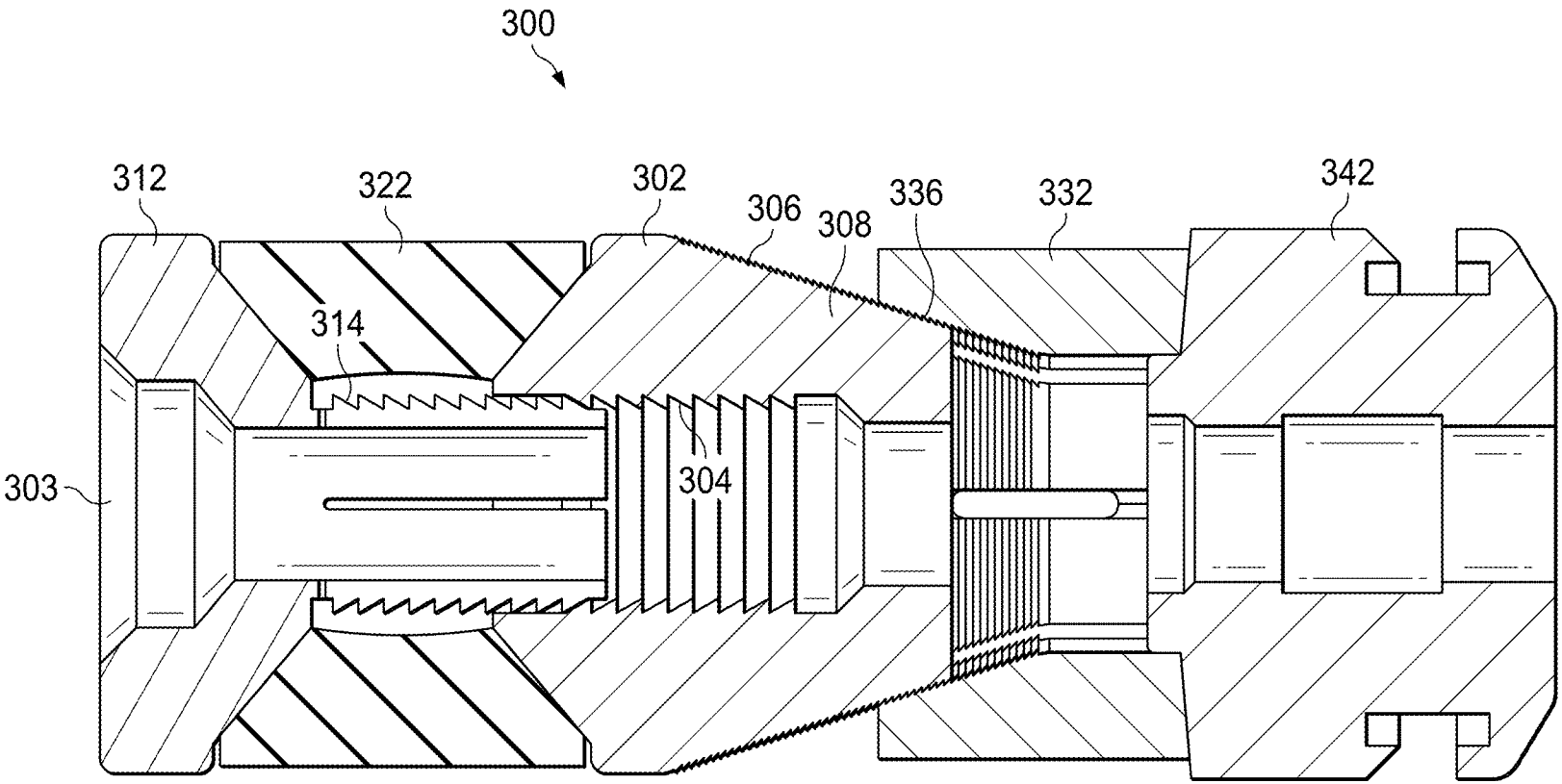
FIG. 3A is a cross-sectional view of another isolation plug similar to the isolation plug of FIG. 2A, where teeth of the ratchet wedge and slip are configured to engage each other to hold the isolation plug in position.

FIG. 3A is a cross-sectional view of another isolation plug 300 similar to isolation plug 200 of FIG. 2A, where teeth of a ratchet wedge 302 and a slip 332 are configured to engage each other to hold a packing element 322 in position after packing element 322 is set. In the embodiment of FIG. 3A, isolation plug 300 includes a ratchet wedge 302 having threads (or teeth or profiles) 304 formed along an interior surface of ratchet wedge 302. Ratchet wedge 302 also has teeth (or threads or profiles) 306 formed along an exterior surface of ratchet wedge 302. Isolation plug 300 also has a ratchet shoe 312 that is coupled to or includes a mandrel 303 having corresponding threads (or teeth or profiles) 314 that are configured to engage threads 304 to permit movement of ratchet shoe 312 towards ratchet wedge 302, but prohibit ratchet shoe 312 from moving away from ratchet wedge 302. In some embodiments, the dimensions of threads 304 and 314 are shaped to permit movement of ratchet shoe 312 towards ratchet wedge 302, but prohibit ratchet shoe 312 from moving away from ratchet wedge 302. A packing element 322 is positioned in between ratchet wedge 302 and ratchet shoe 312. Isolation plug 300 also includes a slip 332 having teeth (or threads or profiles) 336 formed along an interior surface of packing element 322. Isolation plug 300 also has a mule shoe 342 that is configured to guide isolation plug 300 to a desired downhole location, such as near a boundary of a zone.

Pressure or force is applied to ratchet wedge 302, mandrel 303, and/or ratchet shoe 312 to shift ratchet shoe 312 towards ratchet wedge 302. The dimensions and configurations of threads 304 and 314 permit ratchet shoe 312 to shift towards ratchet wedge 302, but prevent ratchet shoe 312 from shifting away from ratchet wedge 302. In the embodiment of FIG. 3A, pressure and/or force applied to ratchet wedge 302, mandrel 303, and/or ratchet shoe 312 also engages teeth 306 of ratchet wedge 302 with corresponding teeth 336 of slip 332. The dimensions and configurations of teeth 306 and 336 permit ratchet wedge 302 to further engage slip 332, but prevents ratchet wedge 302 from disengaging slip 332. In the embodiment of FIG. 3A, engagement of teeth 306 and 336 applies force/pressure to one or more collets 308 of ratchet wedge 302, which in turn engages ratchet wedge 302 to prevent ratchet wedge 302 from disengaging ratchet shoe 312. As ratchet shoe 312 continues to shift towards ratchet wedge 302, force/pressure applied by ratchet wedge 302 and ratchet shoe 312 coming into contact with packing element 322 sets packing element 322. In the embodiment of FIG. 3A, force/pressure applied by ratchet wedge 302 and ratchet shoe 312 coming into contact with packing element 322 causes packing element 322 to radially expand outwards, such as towards the walls of wellbore 114 of FIG. 1.

Figure 3B:
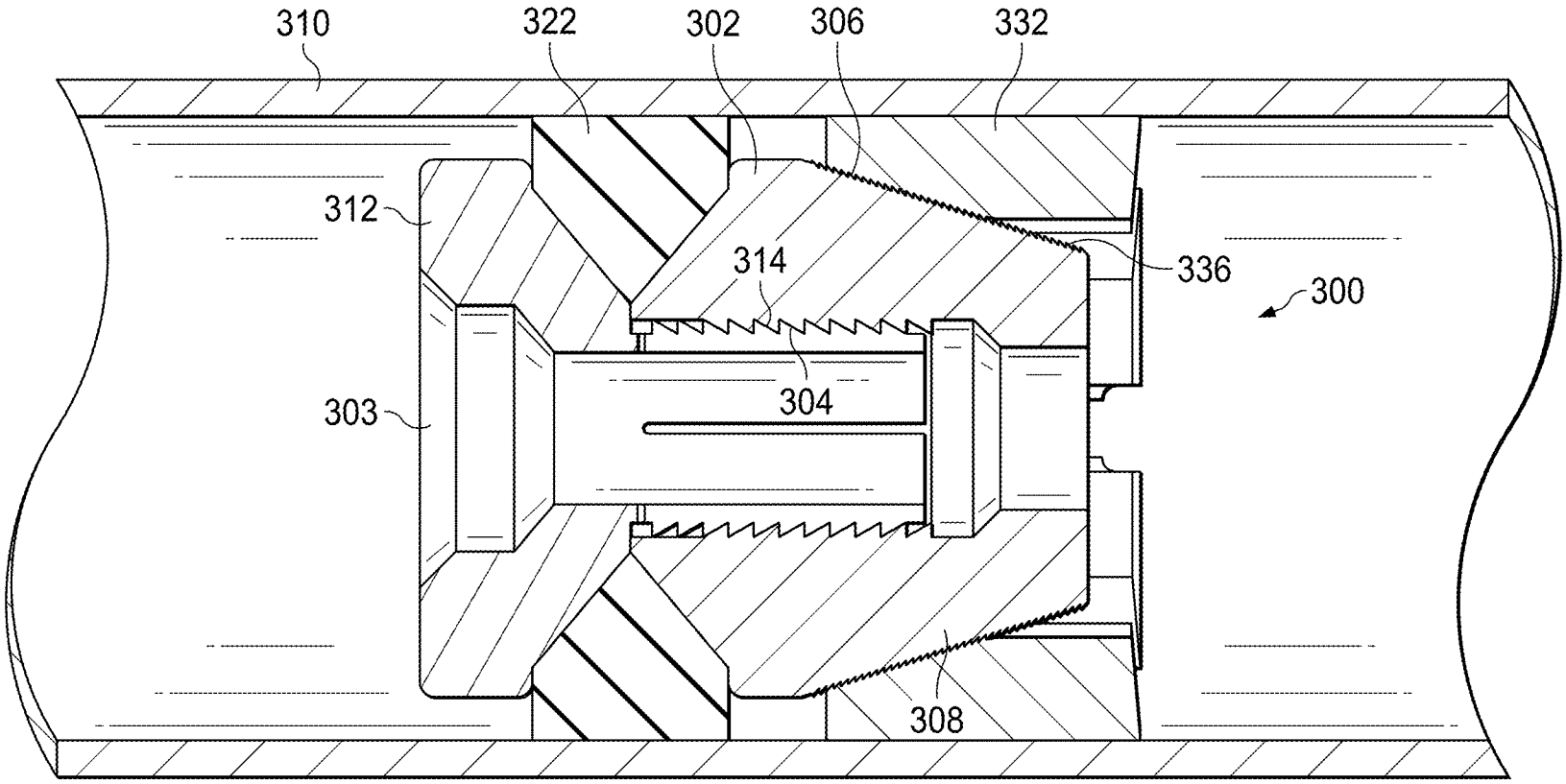
FIG. 3B is a cross-sectional view of the isolation plug of FIG. 3A after the packing element is set.

FIG. 3B is a cross-sectional view of the isolation plug 300 of FIG. 3A after packing element 322 is set. In the embodiment of FIG. 3B, ratchet shoe 312 has ratcheted onto ratchet wedge 302. Further, force/pressure applied by ratchet wedge 302 and ratchet shoe 312 coming into contact with packing element 322 has caused packing element 322 to radially expand outwards to a wall 310. Further, the engagement of threads 304 to threads 314 prevents ratchet shoe 312 from shifting away from ratchet wedge 302, thereby maintaining the set position of packing element 322. Similarly, the engagement of teeth 306 and 336 applies force/pressure to one or more collets 308 of ratchet wedge 302, which in turn engages ratchet wedge 302 to prevent ratchet wedge 302 from disengaging ratchet shoe 312.

Figure 4A:
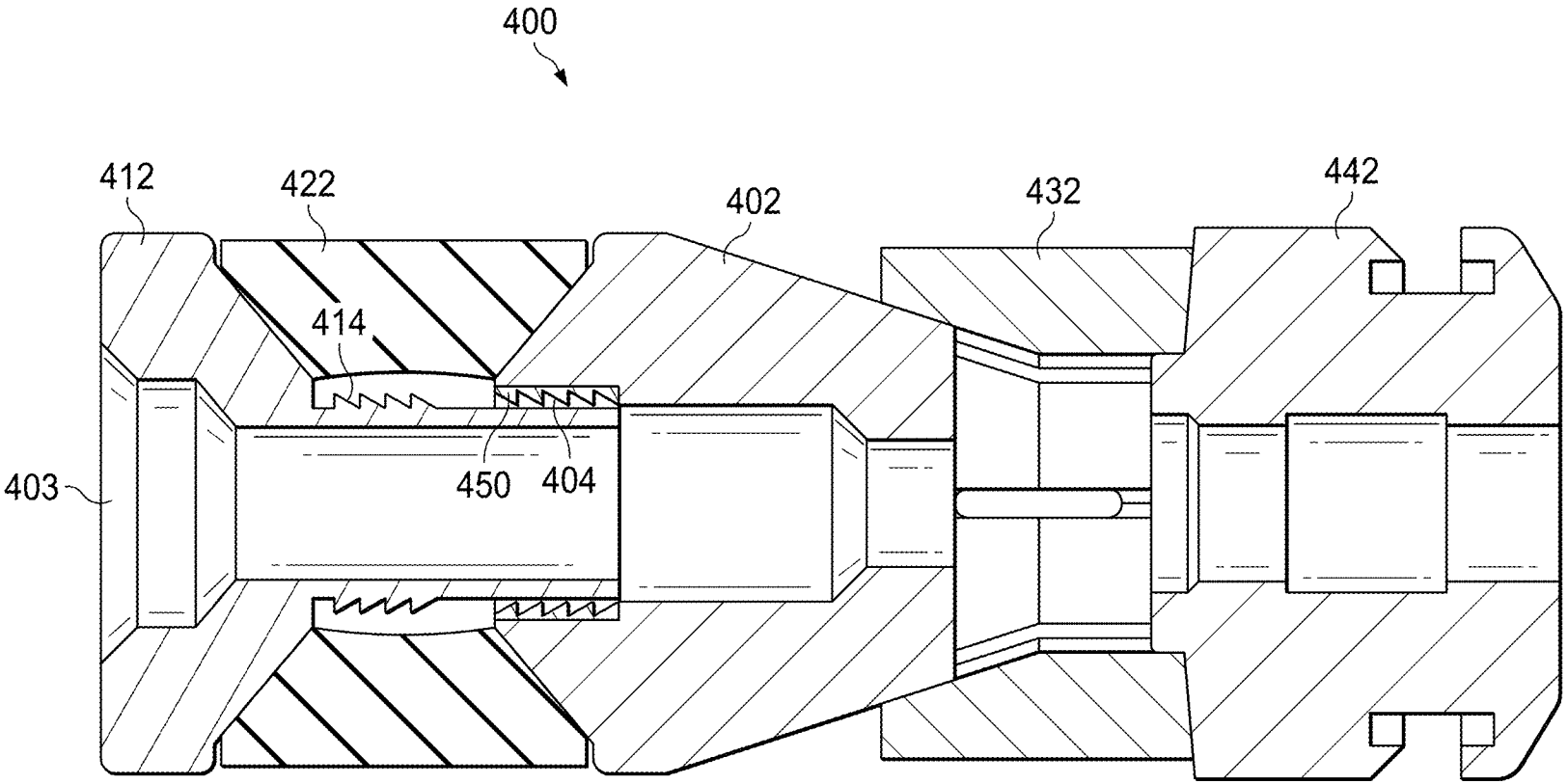
FIG. 4A is a cross-sectional view of another isolation plug similar to the isolation plug of FIG. 2A, and having a lock ring configured to hold the packing element in position after the packing element is set.

FIG. 4A is a cross-sectional view of another isolation plug 400 similar to isolation plug 200 of FIG. 2A, and having a lock ring 450 configured to hold a packing element 422 in position after packing element 422 is set. In the embodiment of FIG. 4A, isolation plug 400 includes a ratchet wedge 402 having threads (or teeth or profiles) 404 formed along an interior surface of ratchet wedge 402. Isolation plug 400 also has a ratchet shoe 412 that is coupled to or includes a mandrel 403 having corresponding threads (or teeth or profiles) 414 that are configured to engage threads 404 to permit movement of ratchet shoe 412 towards ratchet wedge 402, but prohibit ratchet shoe 412 from moving away from ratchet wedge 402. In some embodiments, the dimensions of threads 404 and 414 are shaped to permit movement of ratchet shoe 412 towards ratchet wedge 402, but prohibit ratchet shoe 412 from moving away from ratchet wedge 402. A packing element 422 is positioned in between ratchet wedge 402 and ratchet shoe 412. Isolation plug 400 also includes lock ring 450. In the embodiment of FIG. 4A, lock ring 450 is positioned around threads 404 and 414, and configured to prevent disengagement of ratchet shoe 412 from ratchet wedge 402. Isolation plug 400 also includes a slip 432 configured to hold isolation plug 400 in position, and a mule shoe 442 that is configured to guide isolation plug 400 to a desired downhole location, such as near a boundary of a zone.

Pressure or force is applied to ratchet wedge 402, mandrel 403, and/or ratchet shoe 412 to shift ratchet shoe 412 towards ratchet wedge 402. The dimensions and configurations of threads 404 and 414 permit ratchet shoe 412 to shift towards ratchet wedge 402, but prevent ratchet shoe 412 from shifting away from ratchet wedge 402. Further, lock ring 450 also prevents disengagement of ratchet shoe 412 from ratchet wedge 402. As ratchet shoe 412 continues to shift towards ratchet wedge 402, force/pressure applied by ratchet wedge 402 and ratchet shoe 412 coming into contact with packing element 422 sets packing element 422. In the embodiment of FIG. 4A, force/pressure applied by ratchet wedge 402 and ratchet shoe 412 coming into contact with packing element 422 causes packing element 422 to radially expand outwards, such as towards the walls of wellbore 114 of FIG. 1.

Figure 4B:
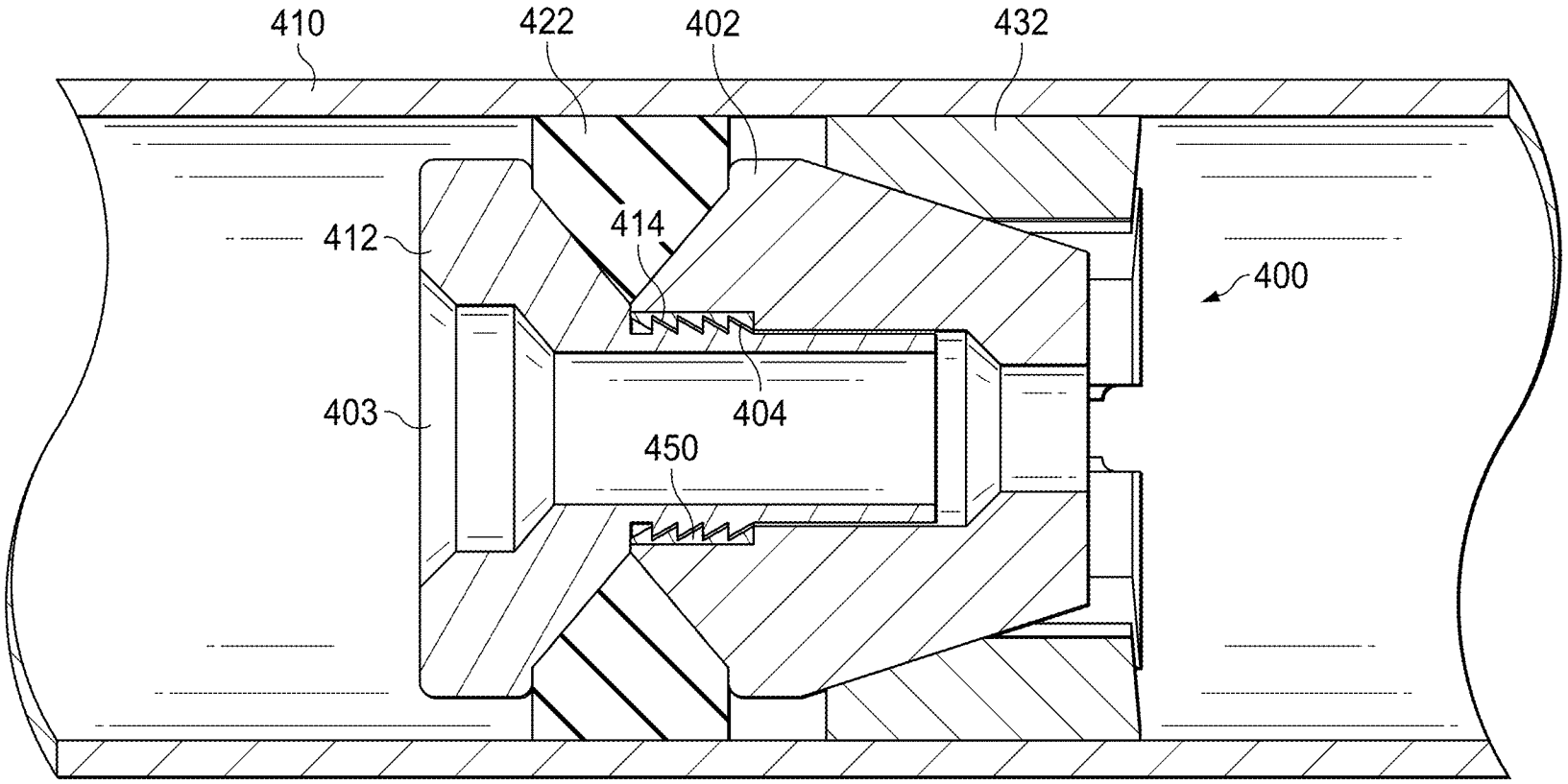
FIG. 4B is a cross-sectional view of the isolation plug of FIG. 4A after the packing element is set.

FIG. 4B is a cross-sectional view of isolation plug 400 of FIG. 4A after packing element 422 is set. In the embodiment of FIG. 4B, ratchet shoe 412 has ratcheted onto ratchet wedge 402. Further, force/pressure applied by ratchet wedge 402 and ratchet shoe 412 coming into contact with packing element 422 has caused packing element 422 to radially expand outwards to a wall 410. Further, the engagement of threads 404 to threads 414 prevents ratchet shoe 412 from shifting away from ratchet wedge 402, thereby maintaining the set position of packing element 422. Similarly, locking ring 450 prevents disengagement of ratchet shoe 412 from ratchet wedge 402.

Figure 5A:
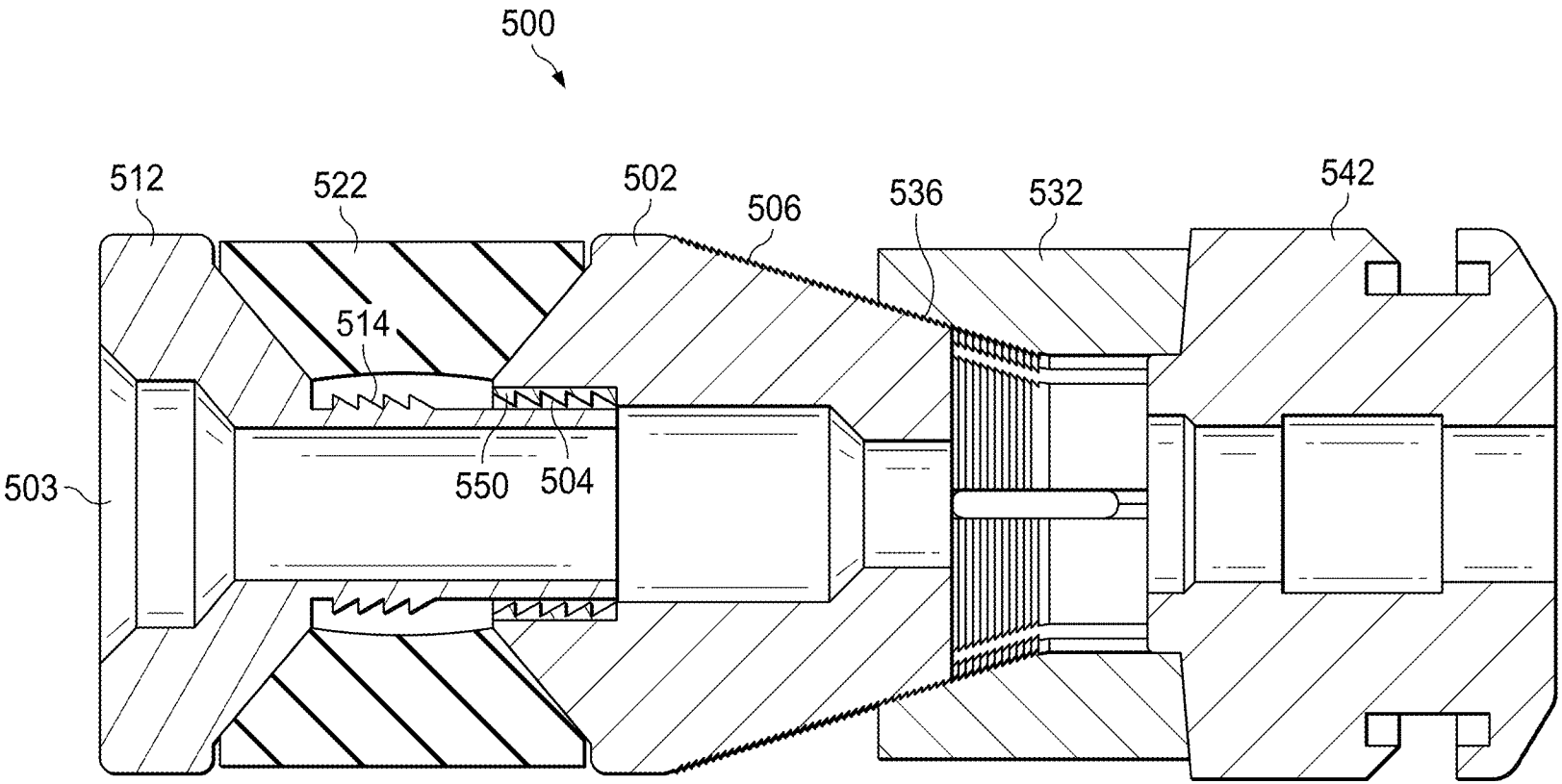
FIG. 5A is a cross-sectional view of another isolation plug similar to the isolation plug of FIG. 3A, and having a lock ring configured to hold the packing element in position after the packing element is set.

FIG. 5A is a cross-sectional view of another isolation plug 500 similar to isolation plug 300 of FIG. 3A, and having a lock ring 550 configured to hold packing element 522 in position after packing element 522 is set. In the embodiment of FIG. 5A, isolation plug 500 includes a ratchet wedge 502 having threads (or teeth or profiles) 504 formed along an interior surface of ratchet wedge 502. Ratchet wedge 502 also has teeth (or threads or profiles) 506 formed along an exterior surface of ratchet wedge 502. Isolation plug 500 also has a ratchet shoe 512 that is coupled to or includes a mandrel 503 having corresponding threads (or teeth or profiles) 514 that are configured to engage threads 504 to permit movement of ratchet shoe 512 towards ratchet wedge 502, but prohibit ratchet shoe 512 from moving away from ratchet wedge 502. In some embodiments, the dimensions of threads 504 and 514 are shaped to permit movement of ratchet shoe 512 towards ratchet wedge 502, but prohibit ratchet shoe 512 from moving away from ratchet wedge 502. A packing element 522 is positioned in between ratchet wedge 502 and ratchet shoe 512. Isolation plug 500 also includes lock ring 550. In the embodiment of FIG. 5A, lock ring 550 is positioned around threads 504 and 514, and configured to prevent the disengagement of ratchet shoe 512 from ratchet wedge 502. Isolation plug 500 also includes a slip 532 having teeth (or threads or profiles) 536 formed along an interior surface of packing element 522. Isolation plug 500 also has a mule shoe 542 that is configured to guide isolation plug 500 to a desired downhole location, such as near a boundary of a zone.

Pressure or force is applied to ratchet wedge 502, mandrel 503, and/or ratchet shoe 512 to shift ratchet shoe 512 towards ratchet wedge 502. The dimensions and configurations of threads 504 and 514 permit ratchet shoe 512 to shift towards ratchet wedge 502, but prevent ratchet shoe 512 from shifting away from ratchet wedge 502. In the embodiment of FIG. 5A, pressure and/or force applied to ratchet wedge 502, mandrel 503, and/or ratchet shoe 512 also engages teeth 506 of ratchet wedge 502 with corresponding teeth 536 of slip 532. The dimensions and configurations of teeth 506 and 536 permit ratchet wedge 502 to further engage slip 532, but prevents ratchet wedge 502 from disengaging slip 532. In the embodiment of FIG. 5A, engagement of teeth 506 and 536 applies force/pressure to lock ring 550, which in turn prevents ratchet shoe 512 from disengaging from ratchet wedge 502. As ratchet shoe 512 continues to shift towards ratchet wedge 502, force/pressure applied by ratchet wedge 502 and ratchet shoe 512 coming into contact with packing element 522 sets packing element 522. In the embodiment of FIG. 5A, force/pressure applied by ratchet wedge 502 and ratchet shoe 512 coming into contact with packing element 522 causes packing element 522 to radially expand outwards, such as towards the walls of wellbore 102 of FIG. 1.

Figure 5B:
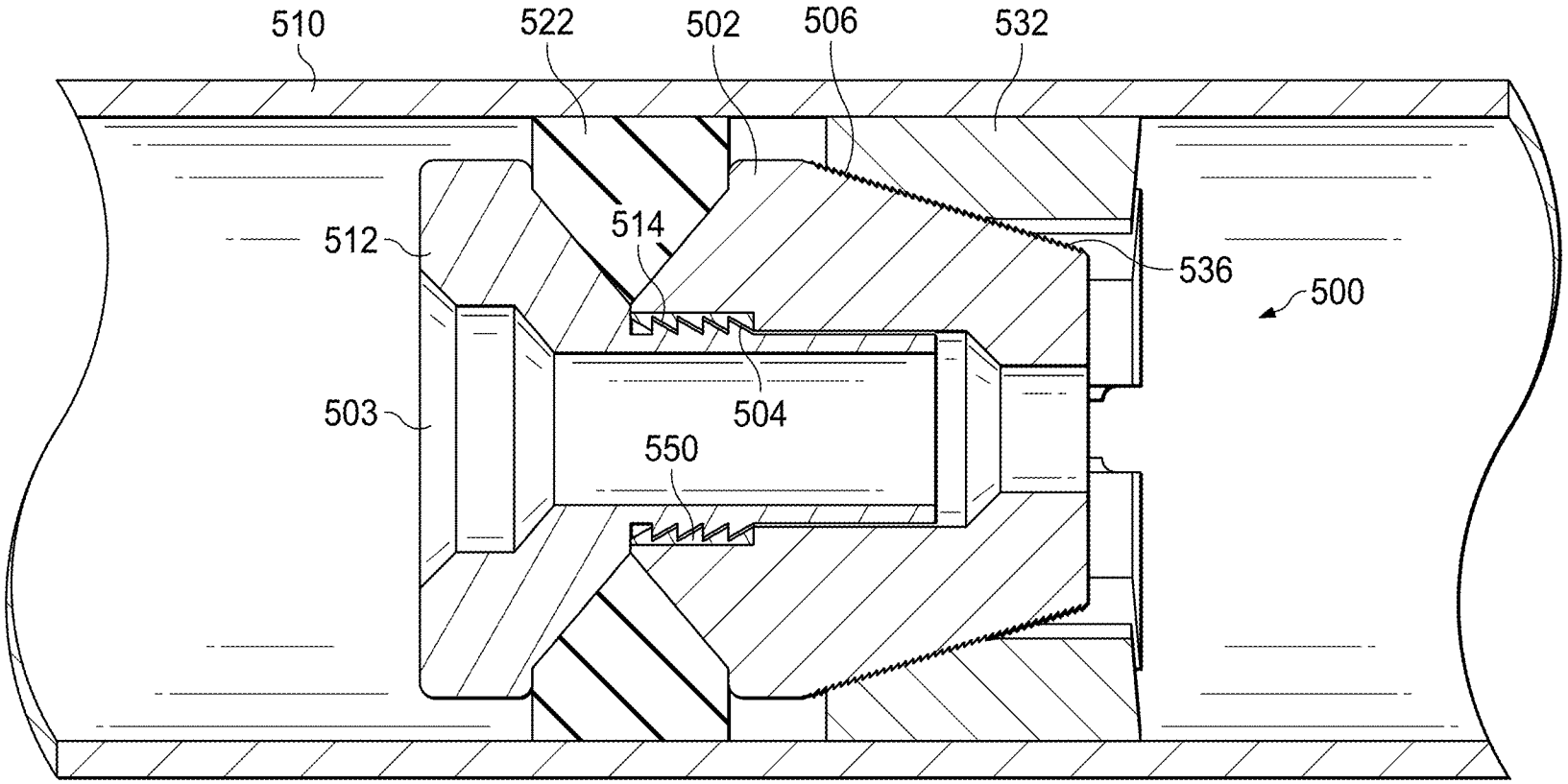
FIG. 5B is a cross-sectional view of the isolation plug of FIG. 5A after the packing element is set.

FIG. 5B is a cross-sectional view of isolation plug 500 of FIG. 5A after packing element 522 is set. In the embodiment of FIG. 5B, ratchet shoe 512 has ratcheted onto ratchet wedge 502. Further, force/pressure applied by ratchet wedge 502 and ratchet shoe 512 coming into contact with packing element 522 has caused packing element 522 to radially expand outwards to a wall 510. Further, the engagement of threads 504 to threads 514 prevents ratchet shoe 512 from shifting away from ratchet wedge 502, thereby maintaining the set position of packing element 522. More particularly, the engagement of teeth 506 and 536 applies force/pressure to locking ring 550, which in turn prevents disengagement of ratchet shoe 512 from ratchet wedge 502.

Figure 6:
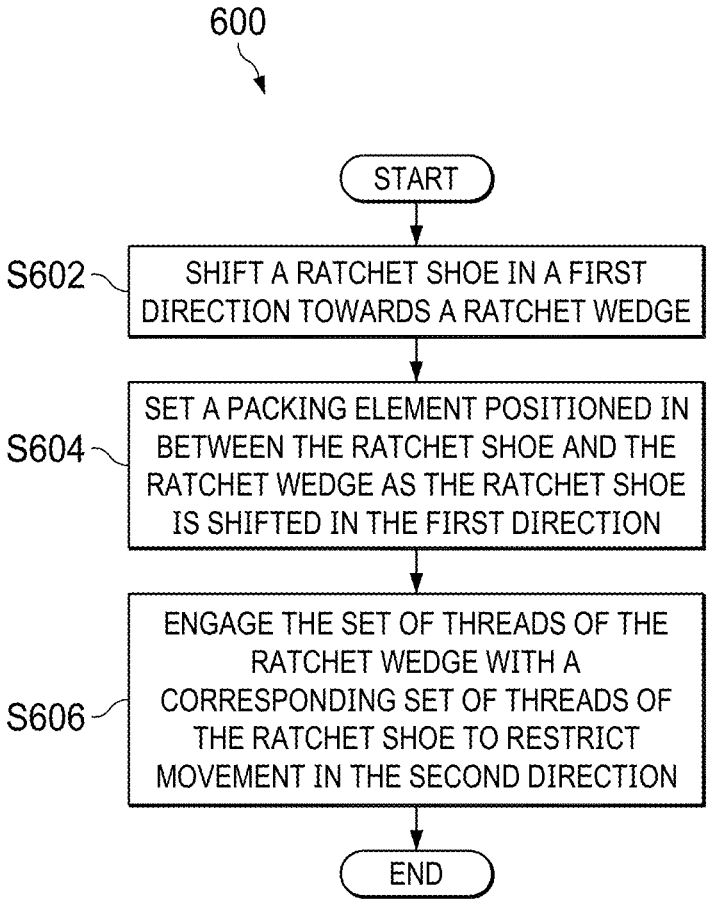
FIG. 6 is a flow chart of a process to set a packing element.

FIG. 6 is a flow chart of a process 600 to set a packing element. Although the operations in process 600 are shown in a particular sequence, certain operations may be performed in different sequences or at the same time where feasible.

At block S602, a ratchet shoe is shifted in a first direction towards a ratchet wedge. In the embodiment of FIG. 2A, force/pressure is applied to ratchet shoe 212, mandrel 203, and/or ratchet wedge 202 to shift ratchet shoe 212 towards ratchet wedge 202. The ratchet shoe and ratchet wedge each has corresponding threads that are configured to engage each other to permit the ratchet shoe to shift towards the ratchet wedge, but prevent the ratchet shoe from shifting away from the ratchet wedge. In some embodiments, force/pressure is also applied to a slip to the ratchet wedge to prevent disengagement of the ratchet wedge from the ratchet shoe. In one or more of such embodiments, ratchet shoe and slip has corresponding teeth that are configured to engage each other, and prevent disengagement of ratchet wedge from the slip. In that regard, FIG. 3B illustrates teeth 306 and 336 of ratchet wedge 302 and slip 332 that are engaged to each other.

At block S604, a packing element positioned in between the ratchet shoe and the ratchet wedge is set as the ratchet shoe is shifted in the first direction. More particularly, force/pressure applied by the ratchet wedge and/or the ratchet shoe coming into contact with the packing element sets the packing element. In the embodiment of FIG. 2B, force/pressure applied by ratchet wedge 202 and/or ratchet shoe 212 coming into contact with the packing element 222 causes packing element 222 to radially expand outwards onto wall 210, thereby forming a seal. At block S606, the set of threads of the ratchet wedge is engaged with a corresponding set of threads of the ratchet shoe to restrict movement in the second direction. As shown in FIG. 2B, threads 204 of ratchet wedge 202 are engaged with corresponding threads 214 of ratchet shoe 212 to hold packing element 222 in position, and to prevent movement of ratchet shoe 212 away from ratchet wedge 202.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowchart depicts a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, an isolation plug, comprising: a ratchet wedge having a set of threads formed along an interior surface of the ratchet wedge, the set of threads configured to permit movement in a first direction towards the ratchet wedge and to restrict movement in a second direction away from the ratchet wedge; a ratchet shoe configured to shift in the first direction to ratchet into the ratchet wedge to engage the ratchet wedge, wherein the ratchet shoe comprises a corresponding set of threads that are configured to engage the set of threads of the ratchet wedge to permit the ratchet shoe to shift in the first direction, and restrict movement in the second direction once the set of threads are engaged with the corresponding set of threads; and a packing element positioned in between the ratchet shoe and the ratchet wedge, the packing element is configured to expand radially as the ratchet shoe is shifted in the first direction.

Clause 2, the isolation plug of clause 1, further comprising a slip coupled to an exterior of the ratchet wedge, the slip configured to engage the ratchet wedge to hold the isolation plug in position.

Clause 3, the isolation plug of clause 2, wherein the slip comprises a first set of teeth along an interior surface of the slip, and wherein the ratchet wedge comprises a corresponding second set of teeth configured to engage the first set of teeth to engage the slip to the ratchet wedge.

Clause 4, the isolation plug of clause 3, wherein engagement of the first set of teeth and the second set of teeth restricts the threads of the ratchet wedge from disengaging the slip.

Clause 5, the isolation plug of any of clauses 1-4, wherein the ratchet wedge comprises one or more collets configured to engage the ratchet shoe to restrict the ratchet shoe from shifting in the second direction, and wherein engagement of the first set of teeth and the second set of teeth applies pressure to the one or more collets to engage the ratchet shoe.

Clause 6, the isolation plug of any of clauses 1-4, wherein the ratchet wedge comprises a lock ring configured to engage the ratchet shoe to restrict the ratchet shoe from shifting in the second direction, and wherein engagement of the first set of teeth and the second set of teeth applies pressure to the lock ring to engage the ratchet shoe.

Clause 7, the isolation plug of any of clauses 1-6, further comprising a mule shoe initially coupled to the slip and configured to guide the isolation plug to a desired location within a wellbore.

Clause 8, the isolation plug of any of clauses 1-7, wherein the packing element is set by pressure applied to the packing element from the ratchet shoe and the ratchet wedge as the ratchet shoe is shifted in the first direction.

Clause 9, the isolation plug of any of clauses 1-8, wherein the packing element is a component of a frac plug.

Clause 10, a ratchet system for setting a packing element downhole, comprising: a ratchet wedge having a set of threads formed along an interior surface of the ratchet wedge, the set of threads configured to permit movement in a first direction towards the ratchet wedge and to restrict movement in a second direction away from the ratchet wedge; and a ratchet shoe configured to shift in the first direction to ratchet into the ratchet wedge to engage the ratchet wedge, wherein the ratchet shoe comprises a corresponding set of threads that are configured to engage the set of threads of the ratchet wedge to permit the ratchet shoe to shift in the first direction, and restrict movement in the second direction once the set of threads are engaged with the corresponding set of threads, wherein pressure applied by the ratchet wedge and the ratchet shoe onto a packing element positioned in between the ratchet shoe and the ratchet wedge expands the packing element radially to set the packing element.

Clause 11, the ratchet system of clause 10, further comprising a slip coupled to an exterior of the ratchet wedge, wherein the slip is configured to engage the ratchet wedge to hold the isolation plug in position.

Clause 12, the ratchet system of clause 11, wherein the slip comprises a first set of teeth along an interior surface of the slip, and wherein the ratchet wedge comprises a corresponding second set of teeth configured to engage the first set of teeth to engage the slip to the ratchet wedge.

Clause 13, the ratchet system of clause 12, wherein engagement of the first set of teeth and the second set of teeth restricts the threads of the ratchet wedge from disengaging the slip.

Clause 14, the ratchet system of any of clauses 10-13, wherein the ratchet wedge comprises one or more collets configured to engage the ratchet shoe to restrict the ratchet shoe from shifting in the second direction, and wherein engagement of the first set of teeth and the second set of teeth applies pressure to the one or more collets to engage the ratchet shoe.

Clause 15, the ratchet system of any of clauses 10-13, wherein the ratchet wedge comprises a lock ring configured to engage the ratchet shoe to restrict the ratchet shoe from shifting in the second direction, and wherein engagement of the first set of teeth and the second set of teeth applies pressure to the lock ring to engage the ratchet shoe.

Clause 16, the ratchet system of any of clauses 10-15, further comprising a mule shoe initially coupled to the slip and configured to guide the isolation plug to a desired location within a wellbore.

Clause 17, a method to set a packing element, comprising: shifting a ratchet shoe in a first direction towards a ratchet wedge, the ratchet wedge having a set of threads formed along an interior surface of the ratchet wedge, the set of threads configured to permit movement in the first direction towards the ratchet wedge and to restrict movement in a second direction away from the ratchet wedge; setting a packing element positioned in between the ratchet shoe and the ratchet wedge as the ratchet shoe is shifted in the first direction; and engaging the set of threads of the ratchet wedge with a corresponding set of threads of the ratchet shoe to restrict movement in the second direction once the set of threads are engaged with the corresponding set of threads.

Clause 18, the method of clause 17, further comprising engaging the ratchet wedge to a slip.

Clause 19, the ratchet system of clause 18, wherein the slip comprises a first set of teeth along an interior surface of the slip, wherein the ratchet wedge comprises a corresponding second set of teeth, and the method further comprising engaging the first set of teeth with the second set of teeth to engage the slip to the ratchet wedge.

Clause 20, the ratchet system of clause 19, wherein engaging of the first set of teeth with the second set of teeth restricts the threads of the ratchet wedge from disengaging the corresponding threads once the threads are engaged with the corresponding threads.

As used herein, the singular forms "a," "an," and "the" are intended to include the plural forms as well, unless the context clearly indicates otherwise. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. An isolation plug, comprising:

a ratchet wedge having a set of threads formed along an interior surface of the ratchet wedge, the set of threads configured to permit movement in a first direction towards the ratchet wedge and to restrict movement in a second direction away from the ratchet wedge;

a ratchet shoe configured to shift in the first direction to ratchet into the ratchet wedge to engage the ratchet wedge, wherein the ratchet shoe comprises a corresponding set of threads that are configured to engage the set of threads of the ratchet wedge to permit the ratchet shoe to shift in the first direction, and restrict movement in the second direction once the set of threads are engaged with the corresponding set of threads;

a packing element positioned in between the ratchet shoe and the ratchet wedge, the packing element is configured to expand radially in response to force applied by the ratchet shoe and the ratchet wedge as the ratchet shoe is shifted in the first direction toward the ratchet wedge; and a slip positioned between the ratchet wedge and a mule shoe, wherein the slip is configured to expand radially to hold the isolation plug in position.

2. The isolation plug of claim 1, wherein the slip is coupled to an exterior of the ratchet wedge, and wherein the slip is configured to engage the ratchet wedge to hold the isolation plug in position.

3. The isolation plug of claim 2, wherein the slip comprises a first set of teeth along an interior surface of the slip, and wherein the ratchet wedge comprises a corresponding second set of teeth configured to engage the first set of teeth to engage the slip to the ratchet wedge.

4. The isolation plug of claim 3, wherein engagement of the first set of teeth and the second set of teeth restricts the threads of the ratchet wedge from disengaging the slip.

5. The isolation plug of claim 1, wherein the ratchet wedge comprises a lock ring configured to engage the ratchet shoe to restrict the ratchet shoe from shifting in the second direction, and wherein engagement of the first set of teeth and the second set of teeth applies pressure to the lock ring to engage the ratchet shoe.

6. The isolation plug of claim 1, further comprising the mule shoe initially coupled to the slip and configured to guide the isolation plug to a desired location within a wellbore.

7. The isolation plug of claim 1, wherein the packing element is set by pressure applied to the packing element from the ratchet shoe and the ratchet wedge as the ratchet shoe is shifted in the first direction.

8. The isolation plug of claim 1, wherein the packing element is a component of a frac plug.

9. A ratchet system for setting a packing element downhole, comprising:

a ratchet wedge having a set of threads formed along an interior surface of the ratchet wedge, the set of threads configured to permit movement in a first direction towards the ratchet wedge and to restrict movement in a second direction away from the ratchet wedge;

a ratchet shoe configured to shift in the first direction to ratchet into the ratchet wedge to engage the ratchet wedge, wherein the ratchet shoe comprises a corresponding set of threads that are configured to engage the set of threads of the ratchet wedge to permit the ratchet shoe to shift in the first direction, and restrict movement in the second direction once the set of threads are engaged with the corresponding set of threads, wherein pressure applied by the ratchet wedge and the ratchet shoe onto a packing element positioned in between the ratchet shoe and the ratchet wedge expands the packing element radially to set the packing element; and a slip positioned between the ratchet wedge and a mule shoe, wherein the slip is configured to expand radially to hold the isolation plug in position.

10. The ratchet system of claim 9, wherein the slip is coupled to an exterior of the ratchet wedge, wherein the slip is configured to engage the ratchet wedge to hold the isolation plug in position.

11. The ratchet system of claim 10, wherein the slip comprises a first set of teeth along an interior surface of the slip, and wherein the ratchet wedge comprises a corresponding second set of teeth configured to engage the first set of teeth to engage the slip to the ratchet wedge.

12. The ratchet system of claim 11, wherein engagement of the first set of teeth and the second set of teeth restricts the threads of the ratchet wedge from disengaging the slip.

13. The ratchet system of claim 9, wherein the ratchet wedge comprises a lock ring configured to engage the ratchet shoe to restrict the ratchet shoe from shifting in the second direction, and wherein engagement of the first set of teeth and the second set of teeth applies pressure to the lock ring to engage the ratchet shoe.

14. The ratchet system of claim 9, wherein the mule shoe is initially coupled to the slip and configured to guide the isolation plug to a desired location within a wellbore.

15. The system of claim 9, wherein the mule shoe is detachable from the isolation plug after the packing element is set.

16. A method to set a packing element of an isolation plug, comprising:

shifting a ratchet shoe in a first direction towards a ratchet wedge, the ratchet wedge having a set of threads formed along an interior surface of the ratchet wedge, the set of threads configured to permit movement in the first direction towards the ratchet wedge and to restrict movement in a second direction away from the ratchet wedge;

setting a packing element positioned in between the ratchet shoe and the ratchet wedge as the ratchet shoe is shifted in the first direction;

engaging the set of threads of the ratchet wedge with a corresponding set of threads of the ratchet shoe to restrict movement in the second direction once the set of threads are engaged with the corresponding set of threads; and expanding a slip radially to hold the plug in position, wherein the slip is positioned between the ratchet wedge and a mule shoe.

17. The method of claim 16, further comprising engaging the ratchet wedge to the slip.

18. The ratchet system of claim 17, wherein the slip comprises a first set of teeth along an interior surface of the slip, wherein the ratchet wedge comprises a corresponding second set of teeth, and the method further comprising engaging the first set of teeth with the second set of teeth to engage the slip to the ratchet wedge.

19. The ratchet system of claim 18, wherein engaging of the first set of teeth with the second set of teeth restricts the threads of the ratchet wedge from disengaging the corresponding threads once the threads are engaged with the corresponding threads.

20. The system of claim 16, detaching the mule shoe from the isolation plug after the packing element is set.

* * * * *